US005249561A

United States Patent [19]

Thompson

[11] Patent Number: 5,249,561

[45] Date of Patent: Oct. 5, 1993

[54] HYDROCARBON VAPOR SENSOR SYSTEM FOR AN INTERNAL COMBUSTION ENGINE

[75] Inventor: Robert H. Thompson, Redford, Mich.

[73] Assignee: Ford Motor Company, Dearborn, Mich.

[21] Appl. No.: 760,535

[22] Filed: Sep. 16, 1991

[51] Int. Cl.[5] ..... F02M 25/08

[52] U.S. Cl. ..... 123/520; 123/494

[58] Field of Search ..... 123/518, 519, 520, 521, 123/516, 494; 73/119 A

[56] References Cited

U.S. PATENT DOCUMENTS

| | | | |
|---|---|---|---|
| 3,604,254 | 9/1971 | Sabuda . | |
| 3,610,221 | 10/1971 | Stoltman . | |
| 3,690,307 | 9/1972 | O'Neill . | |
| 4,041,777 | 8/1977 | Leunig et al. . | |
| 4,516,552 | 5/1985 | Hofbauer et al. . | |
| 4,641,623 | 2/1987 | Hamburg | 123/518 |
| 4,646,702 | 3/1987 | Matsubara et al. . | |
| 4,700,750 | 10/1987 | Cook | 123/518 |
| 4,703,737 | 11/1987 | Cook | 123/518 |
| 4,748,959 | 6/1988 | Cook et al. | 123/520 |
| 4,763,634 | 8/1988 | Morozumi . | |
| 4,886,026 | 12/1989 | Cook | 123/520 |
| 4,949,695 | 8/1990 | Uranishi | 123/494 |
| 5,085,194 | 2/1992 | Kuroda | 123/479 |
| 5,085,197 | 2/1992 | Mader | 123/518 |

*Primary Examiner*—Carl S. Miller

*Attorney, Agent, or Firm*—Jerome R. Drouillard; Roger L. May

[57] ABSTRACT

A fuel vapor handling system for an internal combustion engine uses a calibrated nozzle in a device which determines the mass flow of fuel vapor being drawn into the engine, so as to permit finer control of the air/fuel ratio.

7 Claims, 2 Drawing Sheets

HYDROCARBON VAPOR SENSOR SYSTEM FOR AN INTERNAL COMBUSTION ENGINE

FIELD OF THE INVENTION

This invention relates to a sensor and system for managing the flow of fuel vapor from the fuel system of an internal combustion engine, with the vapors being consumed by the engine in a controlled manner.

BACKGROUND OF THE INVENTION

As vehicle emission standards increase in stringency, it has become necessary for engine control system designers to devise more sophisticated strategies for the handling of vapors generated by the evaporation of fuel contained within the tanks of the vehicle. This fuel vapor is usually stored in one or more canisters, which are regenerated by causing atmospheric air to flow through the canister with the resulting combined gas stream consisting of air and fuel vapor being inducted into the engine's air intake for combustion. If such regeneration of the canisters is not handled properly, the air/fuel ratio of the engine may be disturbed. This may create a problem because the tailpipe emissions of the engine or vehicle could very well increase if the resulting engine feedgas oxygen level falls outside an acceptable range.

Various schemes have been used for introducing fuel vapors into an engine air inlet in a controlled manner.

U.S. Pat. No. 3,610,221 to Stoltman discloses a system allowing vapors to be drawn into a carburetor through the carburetor's idle and off-idle ports.

U.S. Pat. No. 4,646,702 to Matsubara et al. discloses a system allowing fuel vapors to flow from a storage canister only when certain engine operating parameters are in a satisfactory range, but without sensing the mass flow of the vapor coming from the canister. Unfortunately, without knowing the mass flow of the fuel vapor, it is not possible to precisely control the resulting changes in air/fuel ratio caused by the vapor.

U.S. Pat. No. 3,690,307 to O'Neill discloses a system in which the amount of purge air flowing through the vapor collection device is governed by the magnitude of the air flowing through the engine itself; not attempt is made to assess the mass flow of the vapors coming from the storage device.

U.S. Pat. No. 4,763,634 to Morozumi discloses a system which adjusts the fuel/air ratio control algorithm during vapor collection canister purging. This system, too, suffers from the deficiency that the quality of the vapor is not assessed.

U.S. Pat. No. 4,700,750 to Cook discloses a hydrocarbon flow rate regulator which is responsive to the concentration of hydrocarbon vapor and controls the rate of purge air flow accordingly. The regulator of the '750 patent is not, however, responsive to the mass flow of fuel vapor, and thus does not permit a finer level of control of the air/fuel ratio as with the present invention.

A hydrocarbon vapor sensor according to the present invention utilizes a critical flow nozzle to precisely measure the mass flow through the sensor system.

U.S. Pat. No. 4,516,552 to Hofbauer et al. discloses an air flow measuring device for a fuel injection system which measures the volumetric flow but not the mass flow of air through the sensor.

U.S. Pat. No. 3,604,254 to Sabuda and U.S. Pat. No. 4,041,777 to Leunig et al. disclose critical flow devices for testing automotive carburetors. Critical flow nozzles have been used in certain exhaust gas recirculation control valves used by Ford Motor Company for many years. Such valves control the flow of recirculated exhaust gas without determining the actual mass flow through the system.

It is an object of the present invention to provide a hydrocarbon vapor sensor system for an internal combustion engine which has the capability of determining the mass flow of fuel vapor entering an air intake system from a storage canister, such that a precise level of air/fuel control will be enabled.

It has been determined that vehicles operating on fuels having a high percentage of methanol may present unique problems in terms of cold weather starting ability. A sensor system according to the present invention could be employed for the purpose of accurately metering collected fuel vapor for the purpose of starting an engine fueled on liquids such as M-85 comprising 85% methanol and 15% gasoline.

It is yet another advantage of the present invention that a system according to this invention will allow a vehicle to more precisely control air fuel ratio for the purpose of controlling tailpipe hydrocarbon and carbon monoxide emissions.

Other objects, features and advantages of the present invention will become apparent to the reader of this specification.

SUMMARY OF THE INVENTION

A system for controlling the flow of fuel to an air-breathing internal combustion engine having a fuel vapor storage apparatus includes vapor flow means for determining the mass flow rate of fuel vapor transported from the storage apparatus to the air intake of the engine and main fuel means for supplying fuel to the engine in addition to the fuel vapor. A fuel controller operatively connected with the main fuel supply means and the vapor flow means for measures a plurality of engine operating parameters including the actual air/fuel ratio on which the engine is operating and calculates the desired air/fuel ratio.

The fuel controller means further includes means for operating the main fuel means to deliver an amount of fuel required to achieve the desired air/fuel ratio based on the determined mass flow of fuel vapor from the storage apparatus and on the actual air/fuel ratio. A method according to this invention involves operating the main fuel means such that the difference between the mass flow of fuel required to achieve the desired air/fuel ratio and the mass of fuel contained in the fuel vapor flow is supplied by the main fuel means.

In one embodiment, the vapor flow means includes volumetric flow means for determining the volume flow rate of a combined hydrocarbon vapor and air stream moving from the vapor storage apparatus to the engine's air intake and density measuring means for determining the mass density of the fuel vapor in the combined stream. A mass processor means determines the mass flow rate of the fuel vapor. According to the present invention, the volumetric flow means may comprise a critical flow nozzle having a variable flow area controlled by an axially movable pintle, with the combined gas stream including ambient air and hydrocarbon vapor from the storage apparatus being conducted through the nozzle. A transducer produces a first signal indicative of the pintle's position. The volumetric flow means further comprises means for measuring the temperature of the combined gas stream and for producing a second signal indicative of such temperature, and flow processor means for using the first and second signals to calculate the volumetric flow by using the first signal to determine the flow area of the nozzle and the second signal to determine the density of the air flowing through the nozzle.

A density measuring means according to the present invention may comprise an impactor located such that the combined gas stream discharged by the nozzle will impinge upon and deflect the impactor by an amount which is a function of the mass density of the gas stream, and a transducer for producing a third signal indicative of the impactor's deflected position. The density measuring means further comprises density processor means for using the third signal to calculate the mass density of fuel vapor contained in the combined gas stream by comparing the deflection which would be expected if the combined gas stream contained no fuel vapor with the actual deflection.

DETAILED DESCRIPTION OF THE PREFERRED EMBODIMENT

Figure 1:
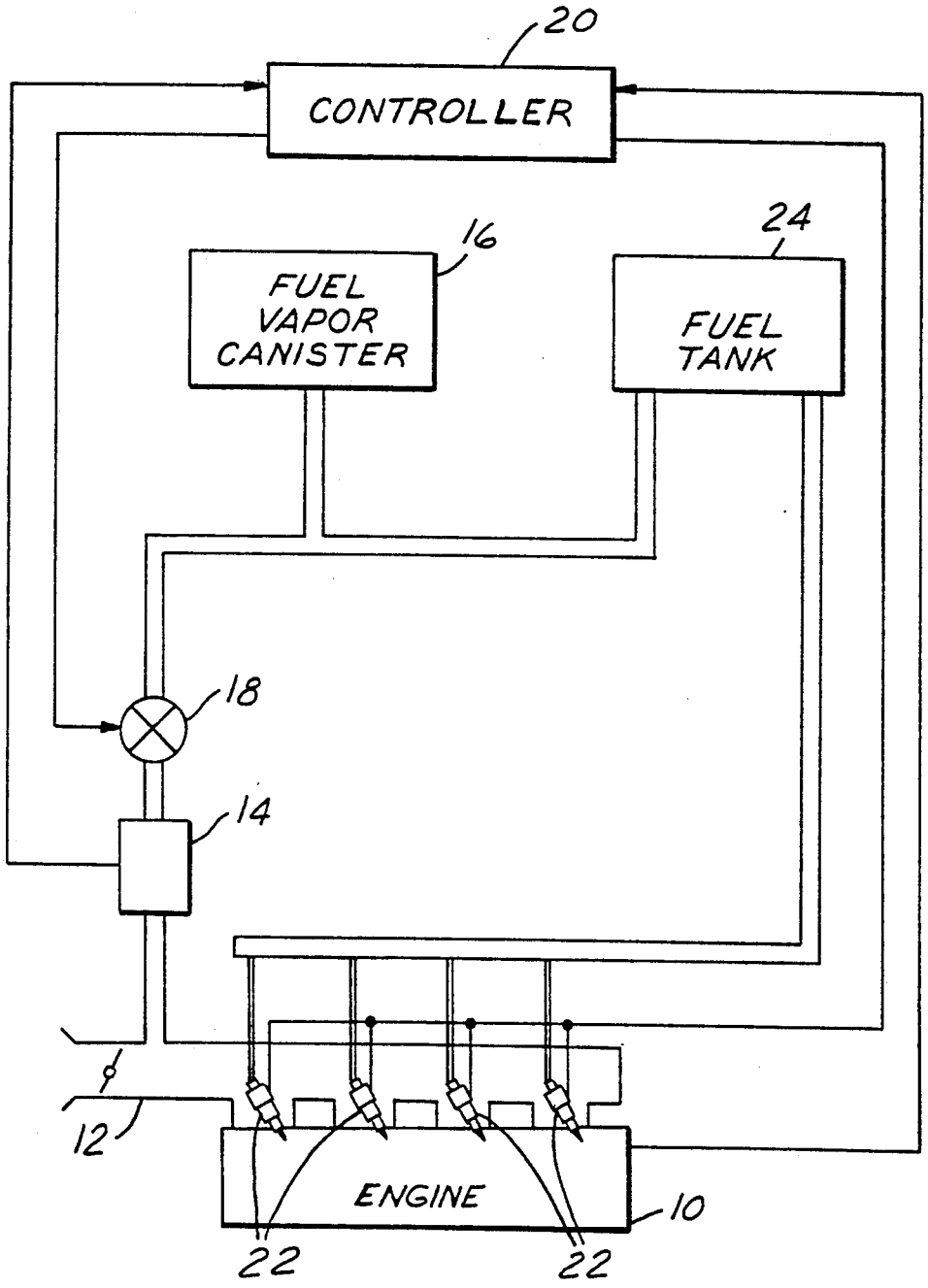
FIG. 1 is a schematic representation of an internal combustion engine having a controller operatively associated with a hydrocarbon mass flow detection system and a main fuel supply system for providing operating fuel requirements for the engine.

As shown in FIG. 1, an air breathing internal combustion engine 10 has an air intake 12. Fuel is introduced to the air intake via a main fuel supply comprising a plurality of injectors, 22. Additional fuel is provided via hydrocarbon mass flow detector 14 which receives fuel vapor from fuel vapor canister 16 and fuel tank 24. Those skilled in the art will appreciate in view of this disclosure that the main fuel supply could comprise either the illustrated port fuel injection apparatus or a conventional carburetor or a conventional throttle body fuel injection system or other type of device intended to provide liquid or gaseous fuel to an internal combustion engine. Note that main fuel supply 22 is controlled by computer 20 which samples a plurality of operating parameters of engine 10. Computer 20 also operates purge control valve 18, which controls the flow of atmospheric air through fuel vapor canister 16 so as to regenerate the canister by entraining fuel vapor into the air stream passing through the canister and into hydrocarbon mass flow detector 14. Purge control valve 18 also controls the flow of fuel vapor from fuel tank 24 into the hydrocarbon flow detector. Controller 20, as noted above, samples or measures a plurality of engine operating parameters such as engine speed, engine load, air/fuel ratio and other parameters. The computer uses this information to calculate a desired air/fuel ratio. Those skilled in the art will appreciate in view of this disclosure that the desired value of the air/fuel ratio could depend upon the type of exhaust treatment device used with the engine. For example, for a three-way catalyst, it may be desirable to dither the ratio about exact stoichiometry. The value of the ratio is not important to the practice of the present invention, however.

Having determined the desired air/fuel ratio and having measured the actual air/fuel ratio, the fuel controller means within the controller will then operate the main fuel means to deliver the amount of fuel required to achieve the desired air/fuel ratio based on the actual air/fuel ratio and on the determined actual mass flow of fuel vapor from the fuel tank or collection canister. The fuel flow in terms of weight per unit of time due to fuel vapor from the evaporative emission control system is merely additive to the fuel flow from the main fuel injection system. In this manner, the air/fuel ratio of the engine is susceptible to the precise control required by the dictates of current and future automotive emission standards.

Those skilled in the art will appreciate in view of this disclosure that the mass processor means, fuel control means, flow processor means and other computer control devices described herein may be combined into a single microprocessor in the manner of engine control computers commonly in use in automotive vehicles at the present time. Alternatively, the controller functions associated with a mass flow sensor according to the present invention could be incorporated in a standalone microprocessor computer.

Figure 2:
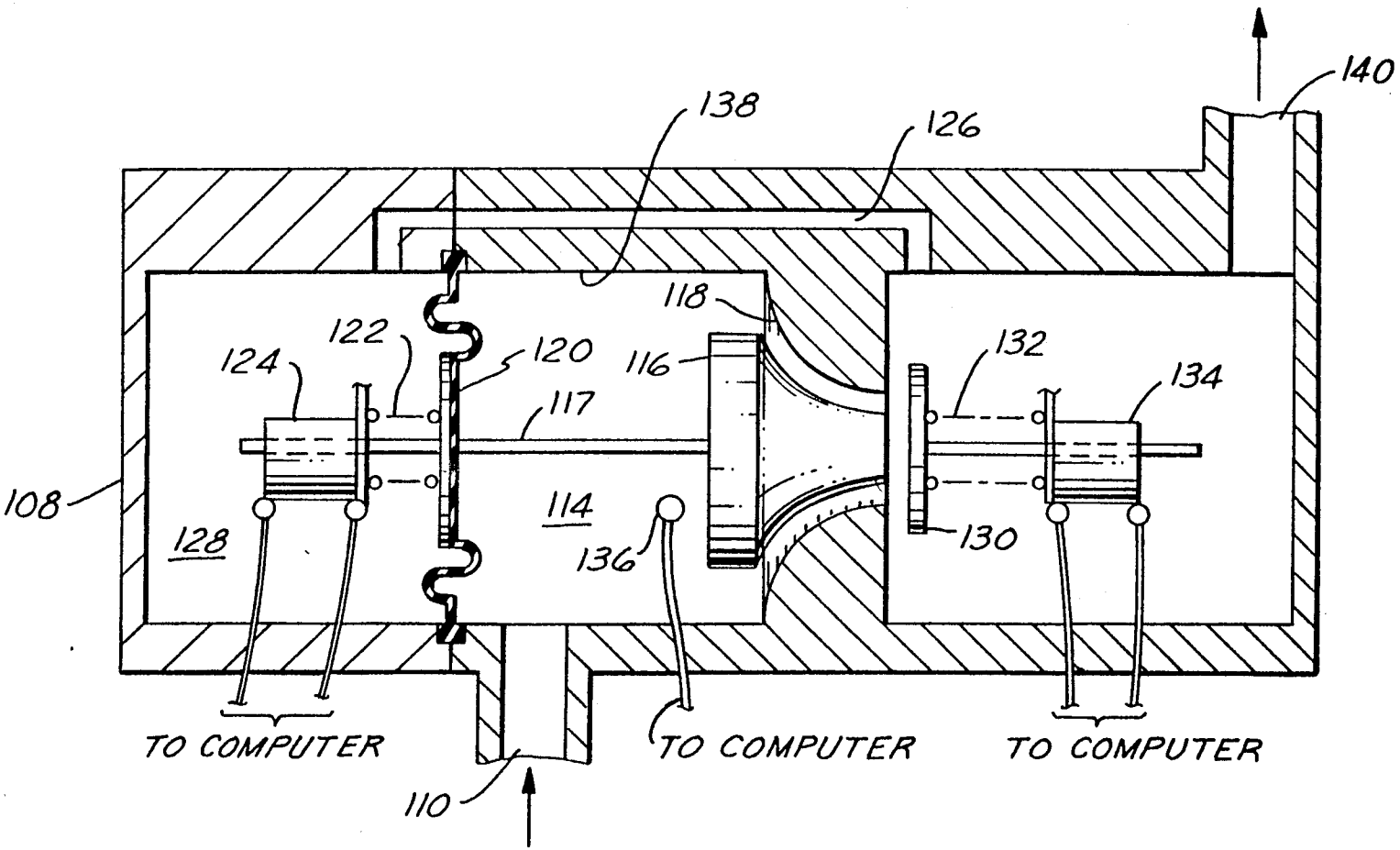
FIG. 2 is a schematic representation of a hydrocarbon mass flow sensor according to the present invention.

FIG. 2 illustrates a hydrocarbon mass flow sensor according to the present invention. As shown in FIG. 1, the sensor receives a mixture of fuel vapor and atmospheric air flowing from fuel vapor canister 16 and fuel tank 24. Vapor flowing through detector 14 continues into air intake 12, wherein the fuel vapor in the combined gas stream from the detector is mixed with other fuel from main fuel supply 22 for combustion within the engine's cylinders. Returning to FIG. 2, the combined gas stream enters detector 14 through inlet port 110, whereupon the combined gas stream passes into inlet chamber 114. Inlet chamber 114 is generally defined by cylindrical bore 138 having a first axial termination defined by nozzle diaphragm 120, which extends across bore 138. The opposite end of chamber 114 is terminated in a nozzle including converging section 118 and pintle 116, which is mounted upon pintle shaft 117. Pintle 116 and pintle shaft 117 are located by nozzle diaphragm 120, acting in concert with nozzle control spring 122. The position of pintle 116 is measured by nozzle transducer 124, which produces a first signal indicative of the pintle's position. Nozzle transducer 124 may comprise a linear variable differential transformer, a potentiometer, a Hall Effect sensor, or any other type of position sensor known to those skilled in the art suggested by this disclosure.

Inlet chamber 114 also includes inlet temperature transducer 136, which is operatively connected with controller 20, as is nozzle transducer 124. Fluid passing through inlet port 110 and inlet chamber 114 passes through the nozzle defined by converging section 118 and pintle 116 and impinges upon an impactor defined by impact plate 130. The combined gas stream impinges upon and deflects impactor 130 by an amount which is a function of the mass density and velocity of the combined gas stream. The steady state position of the impactor is determined by the action of gas striking impactor plate 130 and by impact plate calibration spring 132, which urges impact plate 130 into a position adjacent the nozzle previously described. The impact plate will come to rest at a position in which the force of the combined gas stream equals the opposing force of spring 132. Impact plate transducer 134 produces a third signal indicative of the impactor's deflection position, and the signal is fed to controller 20. It will be appreciated that other types of force measuring devices known to those skilled in the art and suggested by this disclosure could be used for the purpose of determining the force imposed by the flowing gas stream upon impact plate 130.

Nozzle control spring 122 is selected to have a spring rate which, when combined with the gas force acting upon nozzle diaphragm 120, will position pintle 116 within converging section 118 so as to produce an opening area having an appropriate size to produce a pressure drop required to maintain sonic flow through the nozzle. Note that the side of nozzle diaphragm 120 which is directly in contact with the gas in inlet chamber 114 is acted upon by the pressure of gas at the upstream end of the nozzle. Conversely, the side of nozzle diaphragm 120 which forms one wall of control chamber 128 is maintained at a pressure equal to the downstream pressure of the nozzle because bypass passage 126 connects the nozzle discharge area to control chamber 128. As a result, gas pressure within control chamber 128, acting in concert with the force imposed upon nozzle diaphragm 120 by spring 122, will position pintle 116 within converging section 118 so as to produce sonic flow through the nozzle. Controller 20 is then able to predict the mass flow through mass flow detector 14 from the first signal, which is indicative of the nozzle position and flow area, and which is output by nozzle transducer 124. Those skilled in the art will appreciate in view of this disclosure that other means could be used for determining the velocity of flow through a device according to this invention. For example, a transducer could be used to measure the pressure drop across a calibrated orifice so as to permit flow velocity to be calculated.

When air and fuel vapor are flowing through mass flow detector 14, controller 20 will determine the volumetric flow and hydrocarbon mass flow as follows. First, using the second sensor signal, which originates from inlet stagnation temperature transducer 136, the controller will determine the air density, rho. Then, using the first sensor signal, which originates from nozzle transducer 124, the controller will determine the flow area through the nozzle. This could be done by a look-up table method using the value of the signal as an independent variable to determine the flow area; alternatively, the controller will use the first signal in a mathematical expression to determine the flow area through the nozzle. The volumetric flow is calculable according to the following formula:

$$Q = k_0 A((2/rho)delta\ P)^{\frac{1}{2}}$$

where:

Q = volumetric flow $k_0$ = efficiency of nozzle rho = density of flowing fluid delta P = pressure ratio of nozzle, which is fixed A = nozzle flow area, which depends upon pintle position The predicted force exerted by the flowing fluid upon impact plate 130, assuming the fluid is entirely comprised of air, is given by the following expression:

$$F_p = (rho)(Q)(V_f)$$

where:

rho = density of flowing fluid

Q = calculated volumetric flow $V_f$ = velocity of fluid flow which is assumed to be sonic velocity The sonic velocity is calculated as:

$$V_f = (kRT)^{\frac{1}{2}}$$

where:

kR = the gas constant for air

T = the measured stagnation temperature of the combined gas stream.

Having determined the predicted force upon the impact plate, and having the measured value of the actual force, as determined from the compressed length of impact plate calibration spring 132, with the length known by means of impact plate transducer 134, the controller will calculate the mass flow rate of hydrocarbon vapor as follows:

$$M_{HC} = (F_p(Actual) - F_p(predicted))/\ V_f$$

Having determined the mass flow of hydrocarbon vapor, the controller will be able to precisely control the total fuel flow to the engine according to the previously described method.

While only certain embodiments of the present invention have been described, it will be apparent to those skilled in the art that various changes and modifications may be made therein without departing from the spirit and scope of the present invention as claimed.

I claim:

1. A system for controlling the flow of fuel to an air-breathing internal combustion engine having a fuel vapor storage apparatus, said system comprising:

vapor flow means for determining the actual mass flow rate of fuel vapor transported from the storage apparatus into the air intake of the engine;

main fuel means for supplying fuel to the engine in addition to said fuel vapor; and fuel controller means, operatively connected with said main fuel supply means and said vapor flow means, for:

measuring a plurality of engine operating parameters, including the actual air/fuel ratio at which the engine is operating;

calculating a desired air/fuel ratio; and operating the main fuel means to deliver an amount of fuel required to achieve the desired air/fuel ratio, based upon the determined mass flow of fuel vapor from the vapor storage apparatus and upon the actual air/fuel ratio.

2. A system according to claim 1, wherein said vapor flow means comprises a variable area critical flow nozzle which discharges the transported fuel vapor upon an impactor so as to impose a force upon the impactor which is proportional to the mass flow rate of the vapor.

3. A system for controlling the flow of fuel to an air-breathing internal combustion engine having a fuel vapor storage apparatus, said system comprising:

vapor flow means for determining the actual mass flow rate of fuel vapor being transported by purge air flowing from the fuel vapor storage apparatus into the air intake of the engine as a combined gas stream, comprising:

volumetric flow means for determining the volume flow rate of the combined gas stream;

density measuring means for determining the mass density of the fuel vapor in the combined gas stream; and mass processor means for using said determined volumetric flow rate and said determined mass density to calculate the mass flow rate of said fuel vapor;

main fuel means for supplying fuel to the engine in addition to the fuel contained in said purge flow; and fuel controller means, operatively connected with said main fuel supply means and said mass processor means, for:

measuring a plurality of engine operating parameters, including the actual air/fuel ratio at which the engine is operating;

calculating a desired air/fuel ratio; and operating the main fuel means to deliver an amount of fuel required to achieve the desired air/fuel ratio, based upon the determined mass flow of fuel vapor from the vapor storage apparatus and upon the actual air/fuel ratio.

4. A system according to claim 3, wherein said volumetric flow means comprises:

a critical flow nozzle having a fixed pressure ratio and a variable flow area controlled by an axially moveable pintle, with the combined gas stream being conducted through the nozzle;

a transducer for producing a first signal indicative of the pintle's position;

means for measuring the temperature of the combined gas stream and for producing a second signal indicative of such temperature; and flow processor means for using said first and second signals to calculate the volumetric flow by using the first signal to determine the flow area of the nozzle and the second signal to determine the density of the air in the combined gas stream.

5. A system according to claim 4, wherein said density measuring means comprises:

an impactor located such that the combined gas stream discharged by the nozzle will impinge upon and deflect the impactor by an amount which is a function of the mass density of the gas stream;

a transducer for producing a third signal indicative of the impactor's deflected position; and density processor means for using the third signal and the calculated volumetric flow to calculate the mass density of fuel vapor contained in the combined gas stream by comparing the deflection which would be expected if the combined gas stream contained no fuel vapor with the actual deflection.

6. A method for controlling the flow of fuel to an air-breathing internal combustion engine having a fuel vapor storage apparatus for conducting fuel vapor to the engine air intake and main fuel means for supplying the principal fuel requirements to the engine, comprising the steps of:

determining the actual mass flow rate of fuel vapor transported from the storage apparatus into the air intake of the engine;

measuring a plurality of engine operating parameters, including the actual air/fuel ratio at which the engine is operating;

calculating a desired air/fuel ratio; and operating the main fuel means to deliver an amount of fuel required to achieve the desired air/fuel ratio, based upon the determined mass flow of fuel vapor from the vapor storage apparatus and upon the actual air/fuel ratio.

7. A method according to claim 6, wherein said main fuel means is operated such that the difference between the mass flow of fuel required to achieve the desired air/fuel ratio and the mass of fuel contained in the fuel vapor flow is supplied by the main fuel means.

* * * * *